US010369068B2

(12) United States Patent
Sexton

(10) Patent No.: US 10,369,068 B2
(45) Date of Patent: Aug. 6, 2019

(54) HEAD POSITIONING DEVICE

(71) Applicant: Alan Sexton, North Parramatta (AU)

(72) Inventor: Alan Sexton, North Parramatta (AU)

(73) Assignee: Alan Sexton, North Parramatta, New South Wales (AU)

( * ) Notice: Subject to any disclaimer, the term of this patent is extended or adjusted under 35 U.S.C. 154(b) by 326 days.

(21) Appl. No.: 15/122,134

(22) PCT Filed: Feb. 27, 2015

(86) PCT No.: PCT/AU2015/000110
§ 371 (c)(1),
(2) Date: Aug. 26, 2016

(87) PCT Pub. No.: WO2015/127500
PCT Pub. Date: Sep. 3, 2015

(65) Prior Publication Data

US 2016/0361220 A1 Dec. 15, 2016

(30) Foreign Application Priority Data

Feb. 28, 2014 (AU) ..... 2014900662

(51) Int. Cl.
*A61G 13/12* (2006.01)

(52) U.S. Cl.
CPC ..... *A61G 13/1215* (2013.01); *A61G 13/126* (2013.01); *A61G 2203/10* (2013.01)

(58) Field of Classification Search
CPC ..... A61G 13/12
USPC ..... 5/636, 640, 643
See application file for complete search history.

(56) References Cited

U.S. PATENT DOCUMENTS 5,427,436 A * 6/1995 Lloyd ..... A47C 7/38 297/408
6,453,493 B1 * 9/2002 Matthews Brown .. A47D 13/08 5/490
2005/0160532 A1 * 7/2005 Froelich ..... A61G 13/12 5/637

* cited by examiner

*Primary Examiner* — Frederick C Conley
(74) *Attorney, Agent, or Firm* — Kilpatrick Townsend & Stockton LLP

(57) ABSTRACT

Disclosed is a head positioning device for use in laryngoscopy, having a base plate, a head plate, at least one proximal arm and at least one distal arm. The head plate has a proximal end and a distal end. The at least one proximal arm is pivotally connected between the base plate and at or near the proximal end of the head plate. The at least one distal arm is pivotally connected between the base plate and at or near the distal end of the head plate. The proximal and distal arms are operable during use to simultaneously elevate the head plate above the base plate and tilt it at an angle such that the proximal end of the head plate is in a higher elevated position than the distal end.

23 Claims, 12 Drawing Sheets

HEAD POSITIONING DEVICE

CROSS-REFERENCE TO RELATED APPLICATION

This application is a U.S. National Phase of International Application No. PCT/AU2015/000110, filed Feb. 27, 2015, which claims priority from Australian Provisional Application No. 2014900662, filed Feb. 28, 2014, the entire disclosures of which are incorporated by reference herein.

TECHNICAL FIELD

The present invention relates to a head positioning device. Head positioning devices are used in laryngoscopy procedures in which it is necessary to intubate a patient for anaesthesia prior to surgery. It can be used in a hospital, an ambulance or in a patient's home.

BACKGROUND OF THE INVENTION

Endotracheal intubation of a patient for anaesthesia can be achieved via direct laryngoscopy, that is the insertion of a laryngoscope blade into the throat of the patient prior to intubation. The intubation is ideally carried out whilst the patient's head is in an optimal position for open airway visual exposure, known as the "sniffing position". To achieve the sniffing position as a patient lies on his/her back, the patient's head is elevated above a base horizontal position, the patient's neck is extended and the patient's face is maintained in the coronal plane (facing directly upwards as seen in FIG. 10) as the head moves anteriorly relative to the torso. At the correct head elevation, the oropharyngeal, laryngeal and tracheal axes of the patient's head are generally aligned. In this position, the anaesthetist or other practitioner performing the intubation has a clear view of the patient's glottis and vocal cords and intubation can take place.

It is well known that the sniffing position is highly variable and often unique to each individual patient due to anatomical subtleties. Furthermore, it is potentially non-reproducible even in one particular patient due to conditions such as pregnancy, significant weight loss or gain or trauma.

Typical anaesthetist's practice for laryngoscopy involves elevating the patient's head to an initial position, inducing the patient and then inserting a laryngoscope blade into the patient's airway. Insertion of the blade elevates the head further and tilts it back, countering the tendency for chin-on-chest rotation which accompanies head elevation. If further head elevation is required in order to place the patient into the sniffing position then it is achieved by moving the laryngoscope blade itself, which requires considerable force and risks tissue and dental damage.

Various head positioning devices have been developed to assist the anaesthetist in placing the patient into the sniffing position in order to avoid the need for subsequent movement of the laryngoscope. A known head positioning device consists of a pneumatically actuated torso/head support and expandable headrest, each having a separate air bladder that can be inflated to elevate the patient's torso/head and support it in the expandable headrest respectively. The device is disadvantageous in that it requires a costly source of compressed air and employs electromechanical valves that require cumbersome controls in order to restrict the multiple degrees of freedom of head movement that are inherent to the inflatable device. The device is also expensive and is undesirably distracting for the anaesthetist who needs to simultaneously perform the laryngoscopy and direct the pneumatic controls.

Another known head positioning device includes a head support and articulated arms that elevate the head support above a base position, the articulated arms and the head support device having a number of lockable articulated and sliding joints that can be locked once the sniffing position is achieved. The device may be actuated and locked using electronic or mechanical controls for each lock and using mechanical or non-mechanical drivers for each articulating or sliding element of the joints. This device is disadvantageous in several respects. Firstly, the patient's head has multiple degrees of freedom of movement, such that it is difficult for the anaesthetist to accurately identify the sniffing position. Secondly, the amount of manoeuvring of the device that is required to achieve the sniffing position over complicates the procedure. Thirdly, the complex construction of the device and of the control units necessary to operate the device increase manufacturing costs and complexity and increase the risk of malfunction and consequential patient safety issues.

OBJECT OF THE INVENTION

It is the object of the present invention to substantially overcome or at least ameliorate one or more of the above disadvantages.

SUMMARY OF THE INVENTION

According to a first aspect, there is provided a head positioning device for use in laryngoscopy, the head positioning device including a base plate, a head plate having a proximal end and a distal end, at least one proximal arm pivotally connected between the base plate and at or near the proximal end of the head plate and at least one distal arm pivotally connected between the base plate and at or near the distal end of the head plate, wherein the proximal and distal arms are operable during use to simultaneously elevate the head plate above the base plate and tilt it at an angle such that the proximal end of the head plate is in a higher elevated position than the distal end.

Preferably, a distance between an attachment point of the proximal arm and an attachment point of the distal arm to the base plate is approximately equal to the length of the proximal arm. Preferably, a distance between an attachment point of the proximal arm and an attachment point of the distal arm to the head plate is approximately equal to the length of the distal arm.

The device preferably includes a pair of proximal arms that are laterally spaced from one another over a width of the head plate and a pair of distal arms that are laterally spaced from one another over the width of the head plate.

The distal arms are preferably shorter in length than the proximal arms.

The proximal and distal arms are preferably operable, most preferably pivotable, via a hydraulic actuating mechanism.

The hydraulic actuating mechanism preferably includes a user operable handle and a drive rod, the distal arms being fixedly attached to the drive rod for pivotal movement therewith upon user operation of the handle. Preferably, the user operable handle operates a dual action pump that is in fluid communication with a drive rod. More preferably, the dual action pump includes a drive cylinder having a piston disposed therein in mechanical communication with the drive rod, and a fluid reservoir, wherein the user operable handle is operable to pump fluid from the fluid reservoir into the drive cylinder to effect movement of the piston and thereby cause pivotal rotation of the drive rod. Preferably, the drive cylinder includes a bleed valve for the release of fluid therein into the fluid reservoir. Preferably, the fluid is hydraulic fluid.

Preferably, the hydraulic actuating mechanism is operable to elevate the head plate from at least a first base position in which it lies substantially adjacent the base plate to a second elevated position in which the head plate is elevated and tilted at an angle such that the proximal end of the head plate is at a higher elevation than the distal end. The hydraulic actuating mechanism is preferably releasably lockable at the second elevated position. Preferably, a locking mechanism of the hydraulic actuating mechanism includes one or more one-way valves for the admission of fluid into the drive cylinder. Preferably, the locking mechanism is released by opening the bleed valve(s). Preferably, the angle of tilt of the head plate is about 10 to 12 degrees relative to the base plate. Preferably, the proximal end of the head plate is elevated to about 11 to 12 cm above the base plate in the second elevated position.

The user operable handle is preferably collapsible when the hydraulic actuating mechanism is locked in the second elevated position.

The device preferably includes a head support that is releasably attached to an upper surface of the head plate. The head support is preferably a generally C-shaped cushion upon which a patient's head is supported, most preferably made of compliant silicone material, and which preferably also includes a removable cover.

BRIEF DESCRIPTION OF THE DRAWINGS

A preferred embodiment of the present invention will now be described, by way of an example only, with reference to the accompanying drawings wherein.

DETAILED DESCRIPTION OF THE PREFERRED EMBODIMENT

Figure 1:
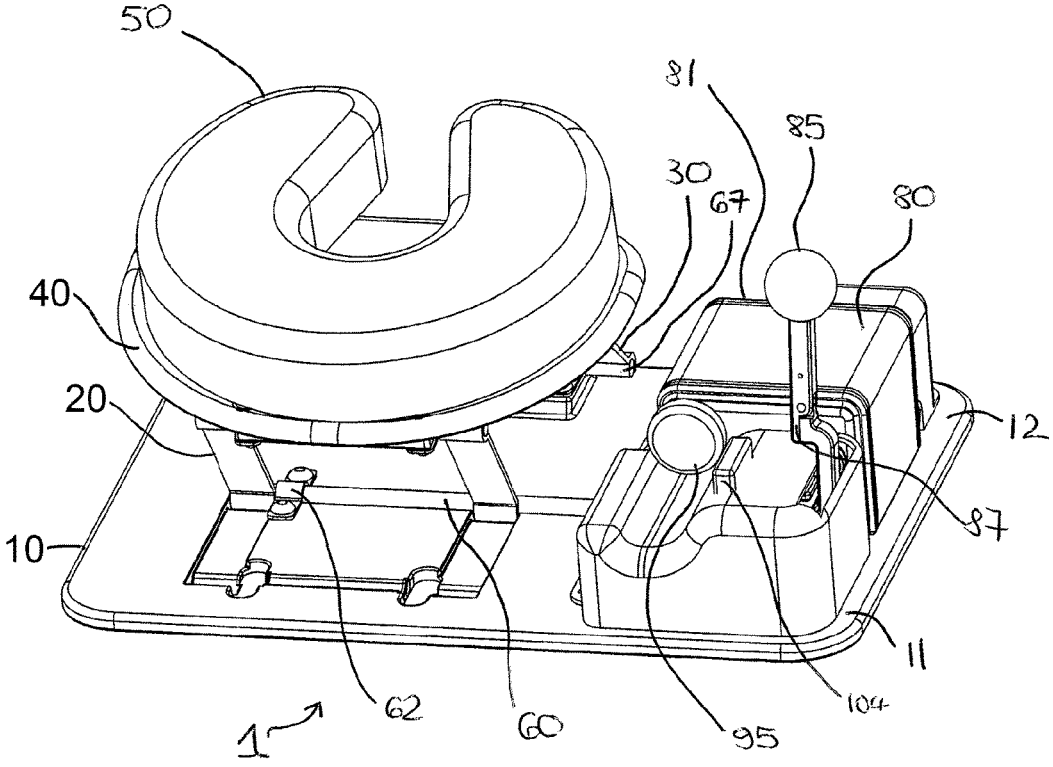
FIG. 1 is a perspective view of a head positioning device.
Figure 2:
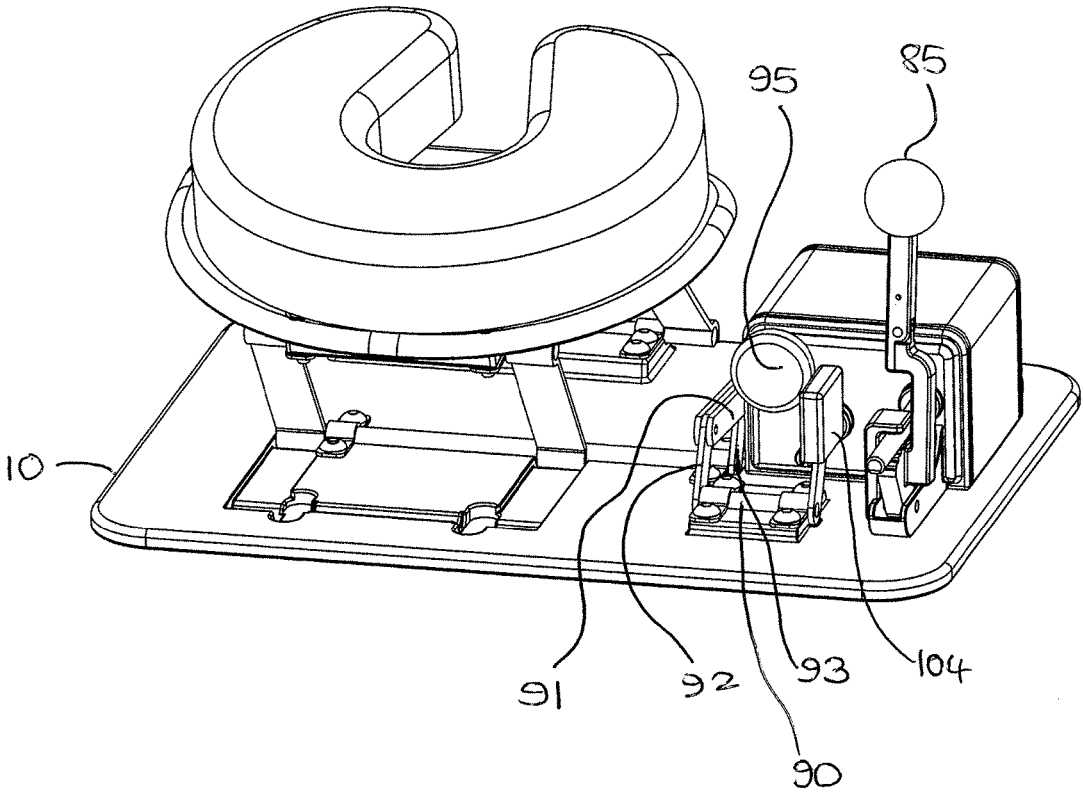
FIG. 2 is a perspective view of the head positioning device of FIG. 1 with the cover of the hydraulic actuating mechanism removed.
Figure 3:
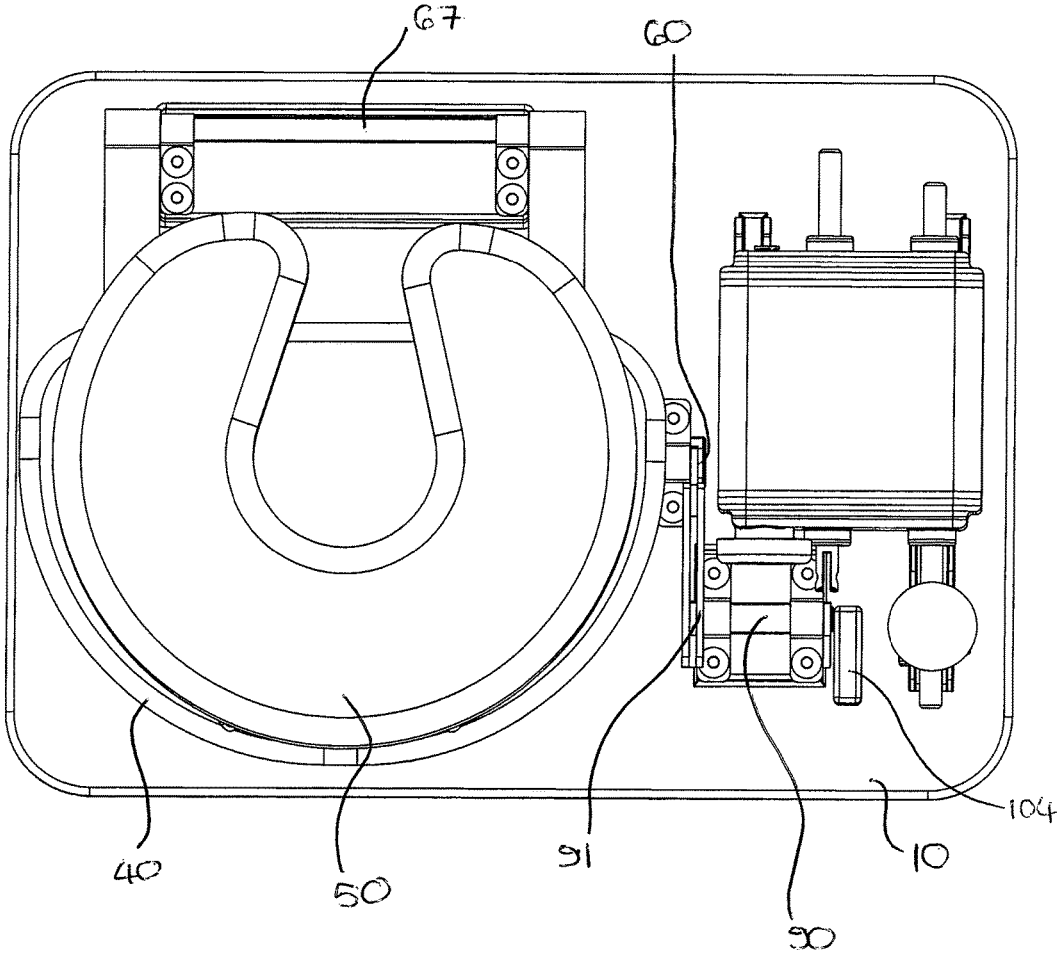
FIG. 3 is a plan view of the head positioning device.
Figure 4:
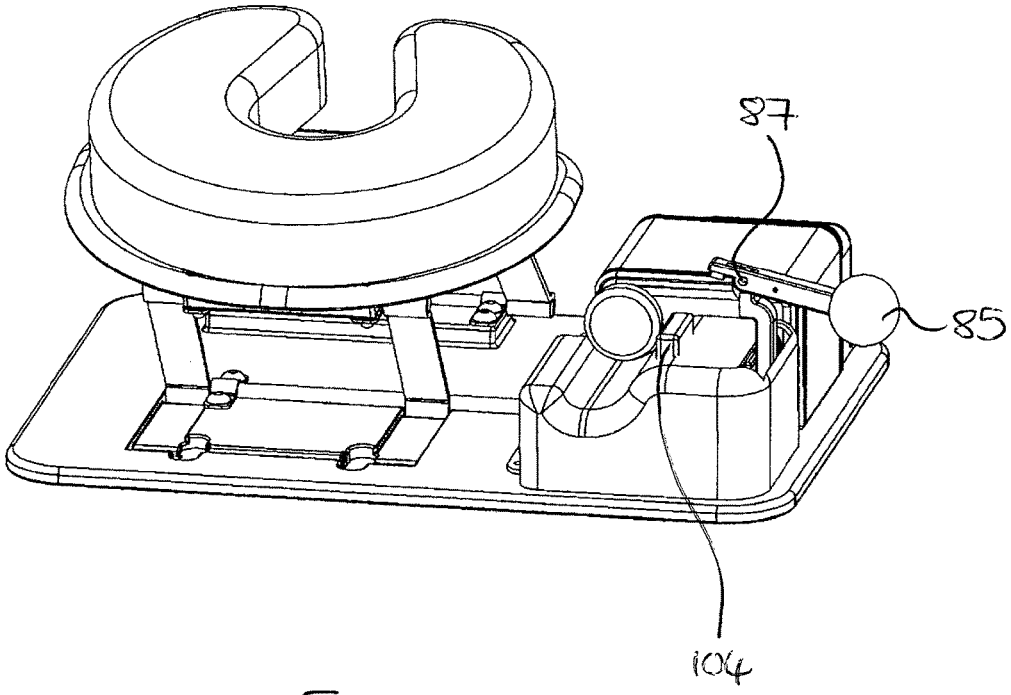
FIG. 4 is a perspective view of the head positioning device showing the operating handle in a collapsed position thereof.

FIG. 1 shows an embodiment of a head positioning device 1 including a base plate 10, a pair of distal arms 20, a pair of proximal arms 30, a head plate 40, a support cushion 50 removably attached to the head plate 40 and a hydraulic actuating mechanism 80.

The base plate 10 has a distal end 11 and a proximal end 12, the distal end 11 and proximal end 12 being defined in relation to the head of a patient 98 during use of the device 1, as shown in FIGS. 7 to 10. The distal arms 20 are laterally spaced from one another and are pivotally mounted at a first end thereof to a drive rod 60 located slightly toward the distal end 11 of the base plate 10. The proximal arms 30 are laterally spaced from one another by the same distance as are the distal arms 20 and are pivotally attached at a first end thereof to a pivot rod 67 located toward the proximal end 12 of the base plate 10. The positions of the drive rod 60 and the pivot rod 67 on the base plate 10 define attachment points of the distal arms 20 and the proximal arms 30 to the base plate 10. A distance between an axis of the drive rod 60 and an axis of the pivot rod 67 is approximately equal to the length of the proximal arms 30. The distal arms 20 are slightly shorter than the proximal arms 30.

The distal arms 20 are pivotally attached at a second end thereof to a distal end of the head plate 40. The proximal arms 30 are pivotally attached at a second end thereof towards a proximal end of the head plate 40. The head plate 40 is a flat plate defining a platform for the support cushion that is attached to an upper surface of the head plate 40 for supporting a patient's head during use of the head positioning device 1.

The support cushion 50 is a C-shaped cushion made of compliant silicone material and includes a removable, washable cover. The firm compliance of the silicone material and its C-shape surrounds and supports the patient's head to minimise lateral movement of the patient's head during elevation of the head plate 40. The support cushion 50 rests on a separate elastic stretchable cover (not shown) that is used to cover the plate 40 and which tucks under the base plate 10 during use. The separate elastic cover is easily removable from the device 1 for sterilisation.

The distal arms 20 are arranged in mechanical communication with a hydraulic actuating mechanism 80 that is arranged on the base plate 10 for the selective elevation and lowering of the distal arms 20, the proximal arms 30 and the head plate 40 with respect to the base plate 10. Specifically, the distal arms 20 are fixedly attached to the drive rod 60 of the hydraulic actuating mechanism 80 for pivotal movement therewith in order to elevate the head plate 40 from an initial base position in which the distal arms 20 lie adjacent the base plate 10, to an elevated position in which the distal arms 20 are fully extended.

Figure 5:
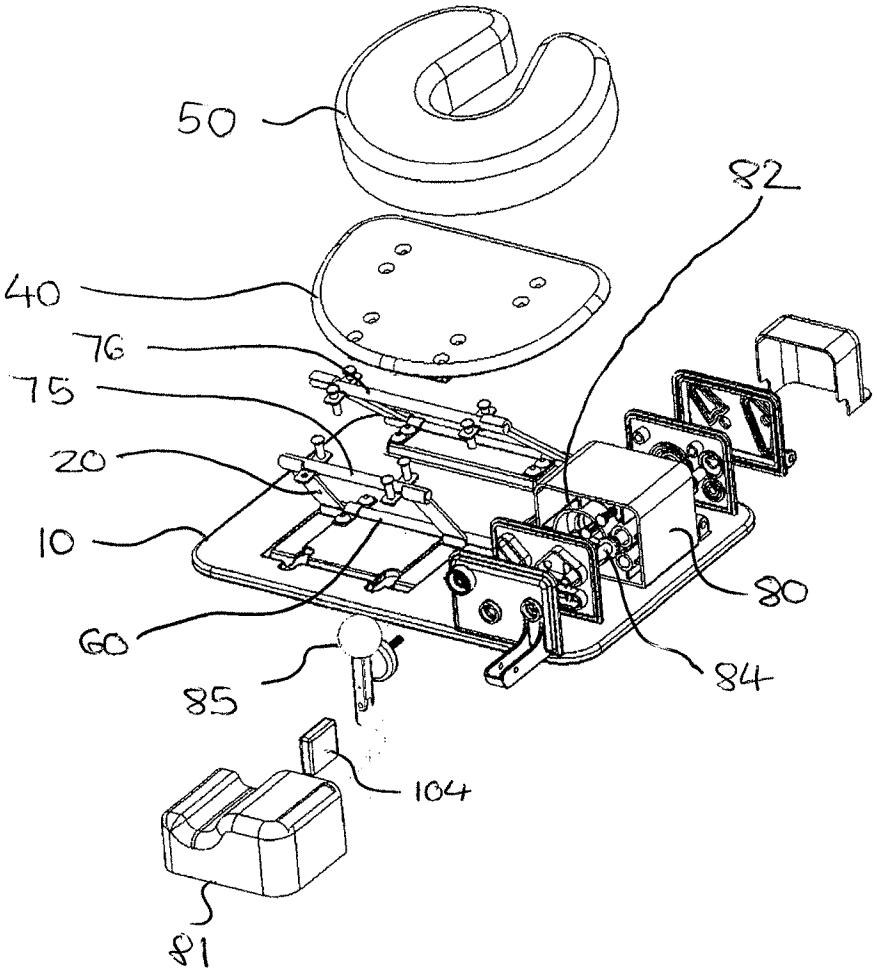
FIG. 5 is an exploded perspective view of the head positioning device.
Figure 6:
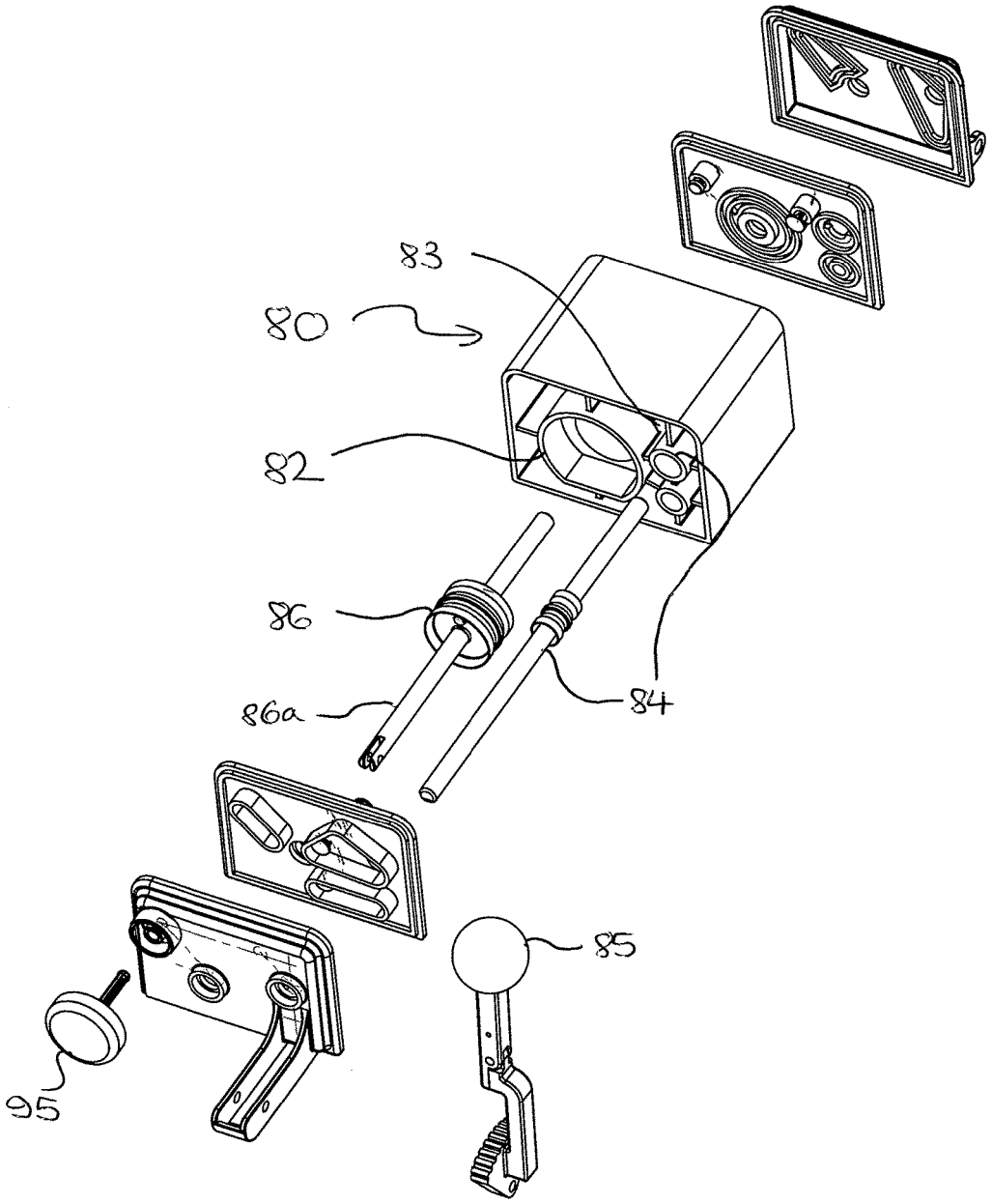
FIG. 6 is an exploded perspective view of the hydraulic actuating mechanism.

As best shown in FIG. 5, the distal arms 20 are pivotally attached to an underside of the head plate 40 via a fixed rod 75 at the distal end of the head plate 40 and the proximal arms 30 are pivotally attached to the underside of the head plate 40 by a fixed rod 76 that is spaced from the fixed rod 75 at the proximal end of the head plate 40. The positions of the fixed rods 75, 76 define attachment points of the distal arms 20 and the proximal arms 30 to the head plate 40. The distance between the fixed rod 75 and the fixed rod 76 is approximately equal to the length of the distal arms 20.

The drive rod 60 of the hydraulic actuating mechanism 80 is affixed to the base plate 10 by a bracket 62. The base plate 10 includes a pair of shallow recesses 65 in an upper surface thereof in which the distal arms 20 are housed when the device is in the initial base position such that they lie substantially flush with the base plate 10.

Figure 11:
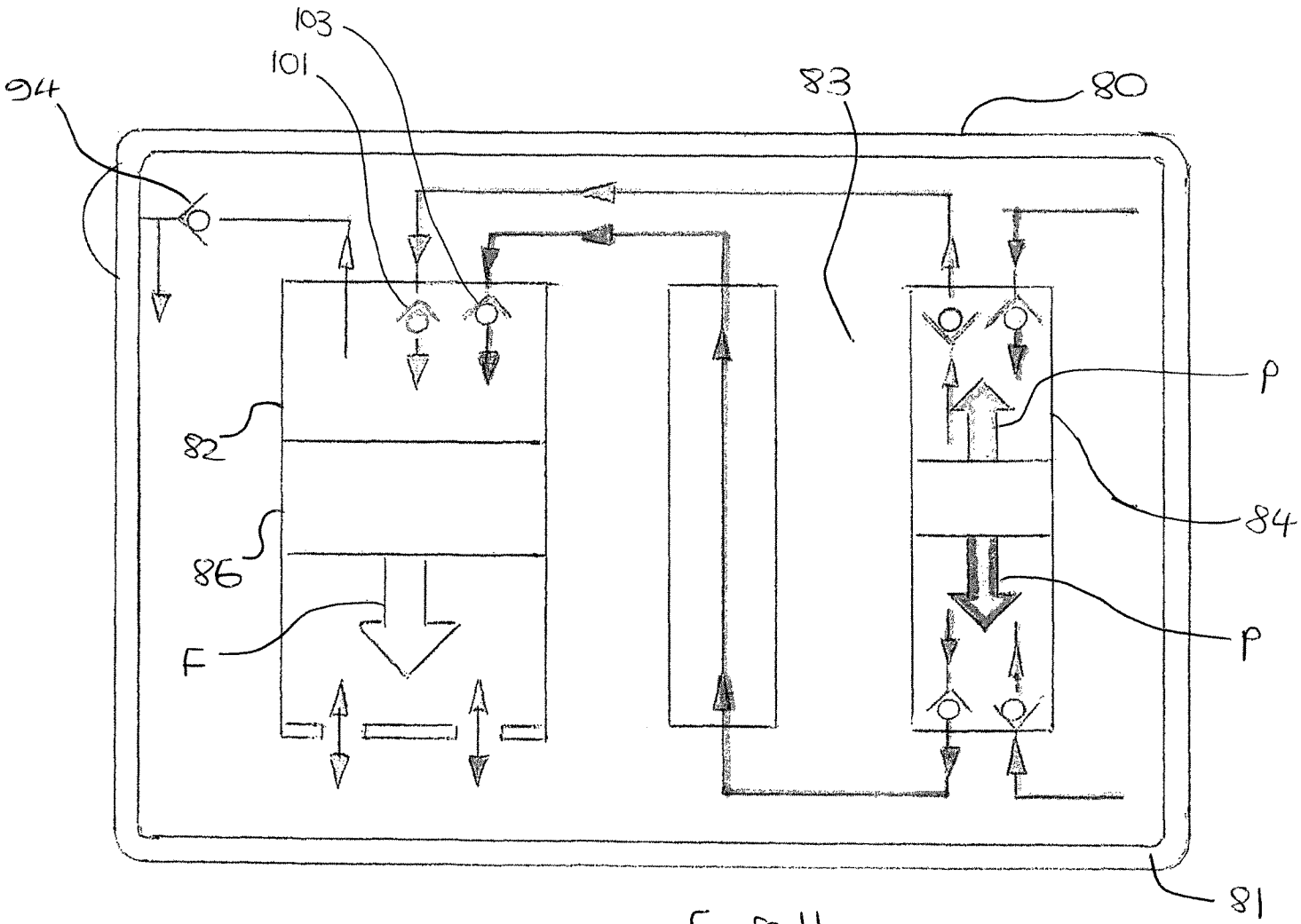
FIG. 11 is a schematic circuit diagram of the hydraulic actuating mechanism.

The hydraulic drive mechanism 80 is shown in FIGS. 2-6 and its operation is shown schematically in FIG. 11. The hydraulic drive mechanism 80 includes a housing 81, a drive cylinder 82, a fluid reservoir 83 containing hydraulic fluid, and a dual action pump 84. The drive cylinder 82 includes one-way valves 101, 103 that are arranged in fluid communication with the pump 84 and which are openable to allow hydraulic fluid into the drive cylinder, A user operable handle 85 (not shown in FIG. 11) is mechanically connected to the pump 84 for pumping the hydraulic fluid from the fluid reservoir 83 to the drive cylinder 82. The pump is actuatable with each forward and backward movement of the handle 85 as shown schematically by the arrows P together with the circuit arrows in FIG. 11. The drive cylinder 82 includes a piston 86 that is mounted on a piston shaft 86*a*, shown in FIG. 6. The piston 86 is driven forwards under the pressure of hydraulic fluid pumped from the reservoir into the drive cylinder 82, as shown by the arrow F in FIG. 11. The piston 86 is in mechanical communication with the drive rod 60 such that movement of the piston 86 within the drive cylinder 82 causes pivotal rotation of the drive rod 60 (not shown in FIG. 11) and subsequent pivotal rotation of the distal arms 20. More specifically, forward movement of the piston 86 and piston shaft 86*a* actuates a rotation of a secondary pivot rod 90 that is fixedly connected to a four bar linkage 91 outside of the drive cylinder 82. The rotation of the secondary pivot rod 90 causes pivotal movement of a first arm 92 of the four bar linkage 91. The motion is transferred to a second arm 93 of the four bar linkage 91. The drive rod 60 is fixedly attached to the second arm 93 of the four bar linkage 92 such that rotational movement of the second arm 93 results in rotational movement of the drive rod 60.

The hydraulic fluid in the drive cylinder 82 is trapped therein by the one-way valves 101, 103 such that the head positioning device 1 is effectively locked into the elevated position or at an intermediate position as is required during use. The user operable handle 85 includes an articulated joint 87 that can be used to retract the handle 85 into a collapsed position when the hydraulic actuating mechanism 80 is locked in position. A rectangular prism 104, seen in FIGS. 1-5, is located adjacent the handle 85 and facing the head plate 40. The prism 104 reflects the movement of the piston shaft 86*a* which, due to its coupling via the pivot rod 90 and four bar linkage 91 to the head plate 40, indicates the height of the head plate 40 to the anaesthetist. The anaesthetist can therefore gauge the height of the head plate 40 even if the separate elastic cover is in place.

The hydraulic actuating mechanism 80 includes a bleed valve 94, shown schematically in FIG. 11, for releasing hydraulic fluid from the drive cylinder 82 when it is desired to lower the head plate 40 to an intermediate position or to the initial base position. A user activatable button 95 is positioned outside the housing 81 adjacent the handle 85 to release the locked hydraulic actuating mechanism. Pressing the button 95 allows the bleed valve 94 to open, slowly releasing the hydraulic fluid from the drive cylinder 82 and slowly lowering the head plate 40.

Figure 7A:
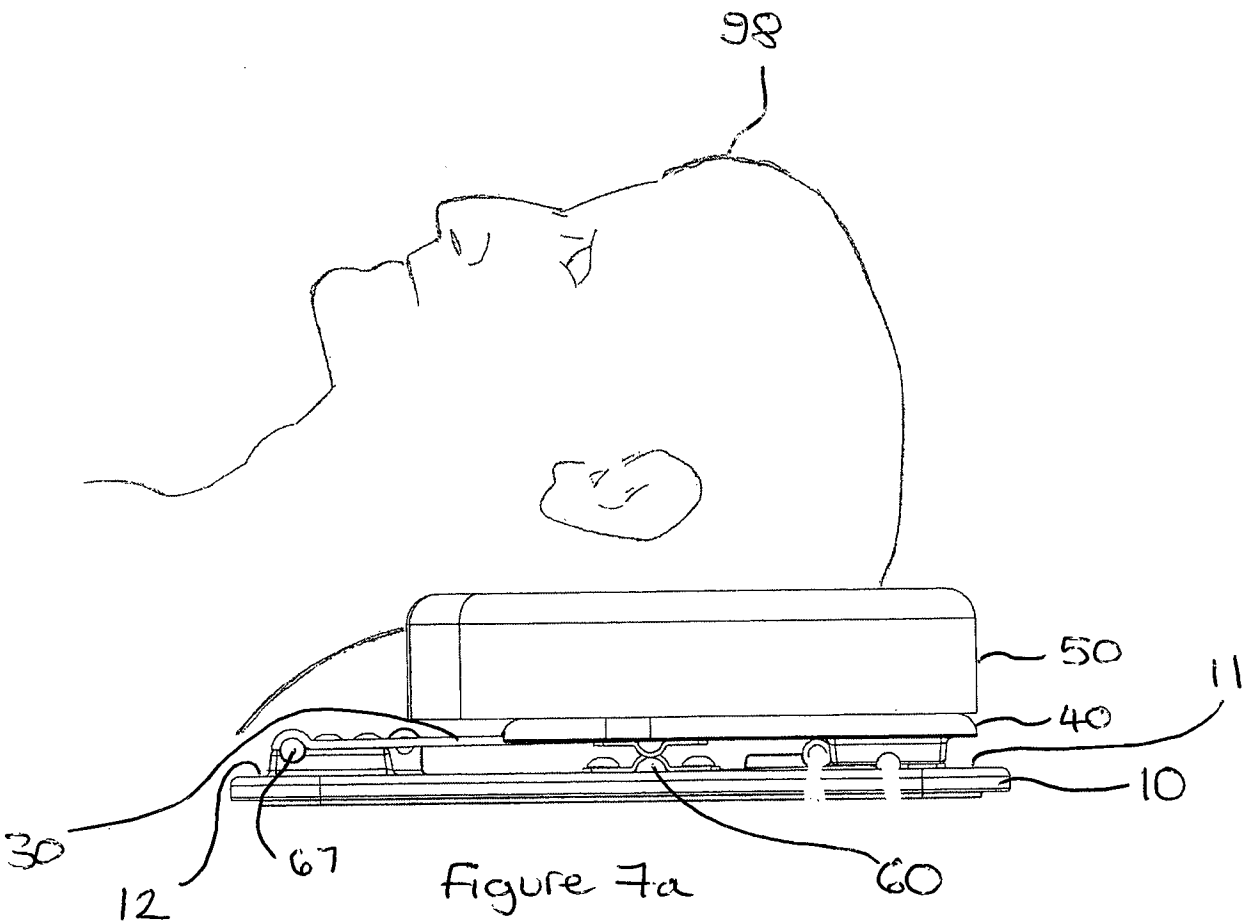
FIG. 7*a* is a schematic side view of the head positioning device in an initial base position.
Figure 7B:
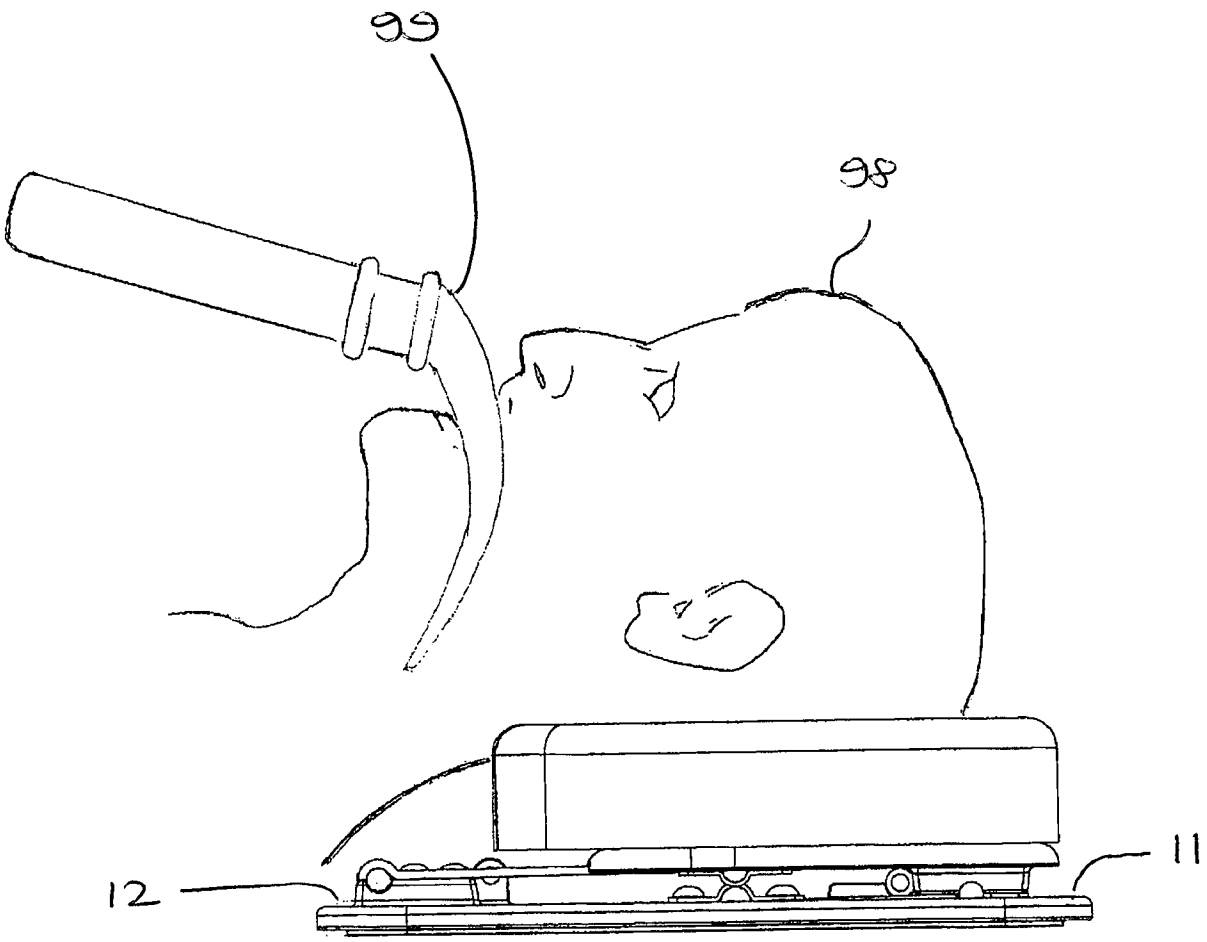
FIG. 7*b* is a schematic side view of the head positioning device in an initial base position and showing insertion of a laryngeal blade.

Operation and use of the head positioning device 1 is described as follows with reference to FIGS. 7*a*-10. The device 1 is placed in the initial base position as seen in FIG. 7*a* in which the distal arms 20 and the proximal arms 30 are lowered and the head plate 40 lies adjacent the base plate 10. With the device in the initial base position a patient's head can comfortably rest in the support cushion 50. The patient's head 98 is elevated by between 2-4 cm and will rest in the coronal plane by default. The patient is induced by the anaesthetist. Following induction, the anaesthetist uses his/her hand to open the patient's airway and to place the laryngoscope blade 99 into the vallecula as shown in FIG. 7*b*. The left hand of the anaesthetist passively holds a handle of the laryngoscope 99.

Figure 8:
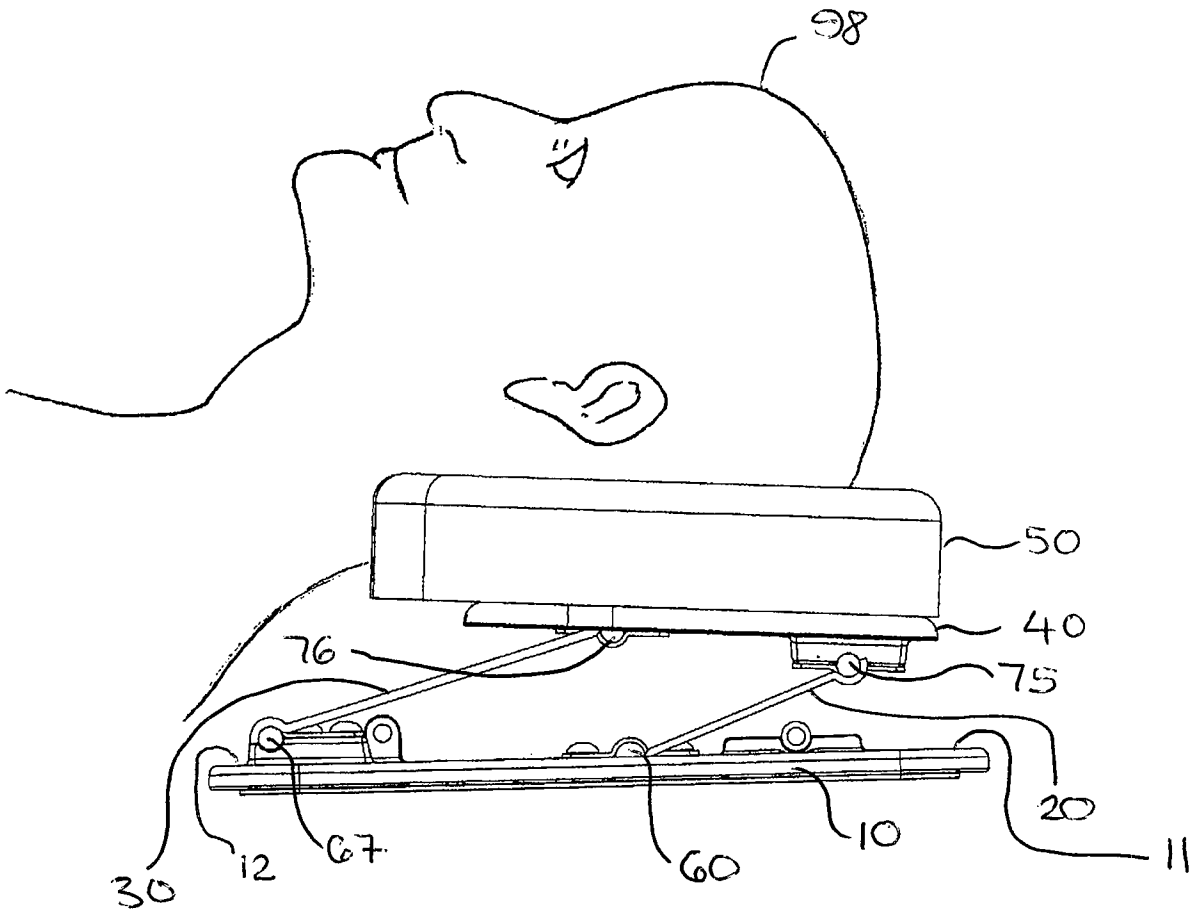
FIG. 8 is a schematic side view of the head positioning device with the head plate elevated to a first intermediate position.
Figure 9:
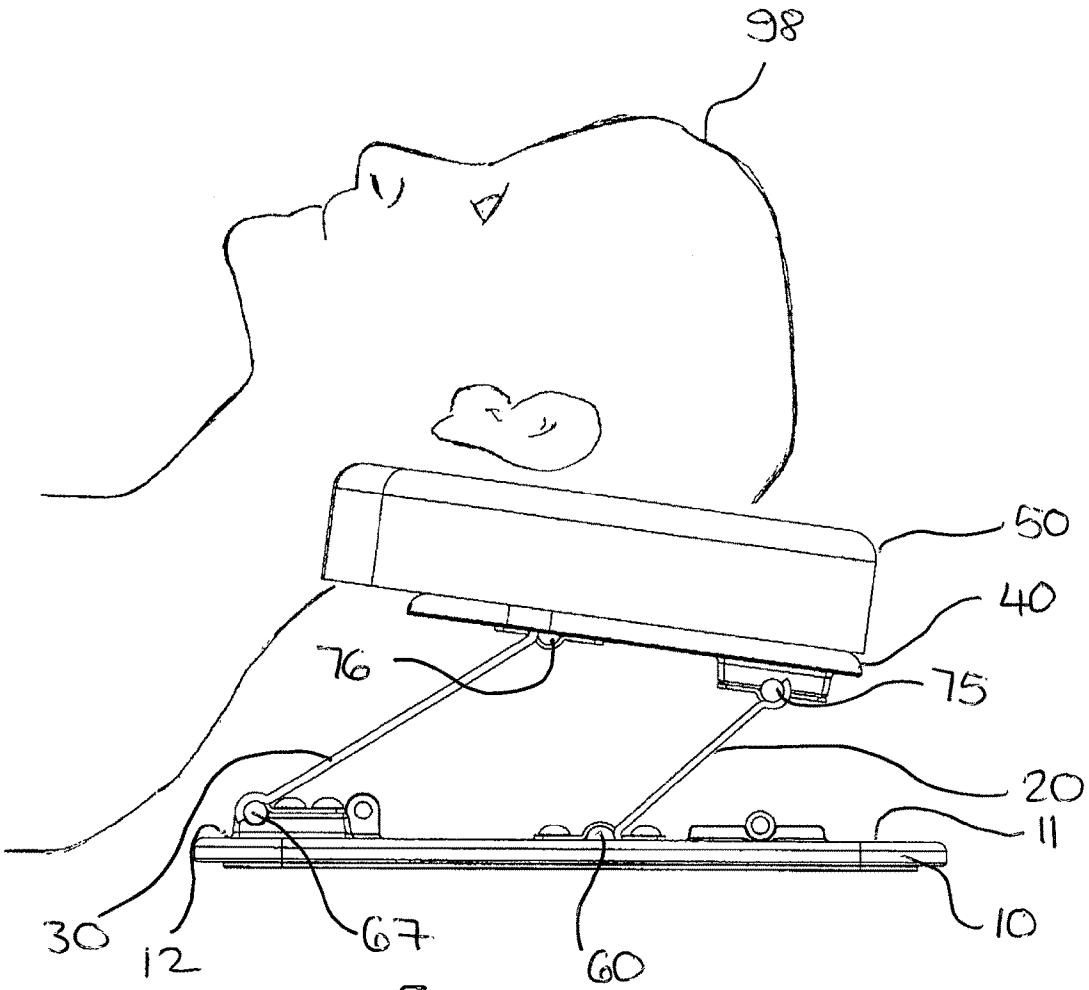
FIG. 9 is a schematic side view of the head positioning device with the head plate elevated to a second intermediate position.

The anaesthetist operates the user operable handle 85 to pump hydraulic fluid into the drive cylinder 82 with each pump stroke of the handle 85. As hydraulic fluid is pumped into the drive cylinder 82, the drive rod 60 is rotated and the distal and proximal arms 20, 30 and head plate 40 are gradually elevated along the arc of the arms 20, 30. As the head plate 40 is elevated, it is also simultaneously tilted backwards relative to the patient's head 98 as seen in FIGS. 8 and 9 (laryngoscope not shown) due to the distal arms 20 being slightly shorter than the proximal arms 30, to the distance between the attachment points of the arms 20, 30 to the base plate 10 being approximately equal to the length of the proximal arms 30 and to the distance between the attachment points of the arms 20, 30 to the head plate 40 being approximately equal to the length of the distal arms 20. This movement, together with the laryngoscope blade 99 stabilizing the jaw, counters the natural tendency towards 'chin on chest' rotation.

Figure 10:
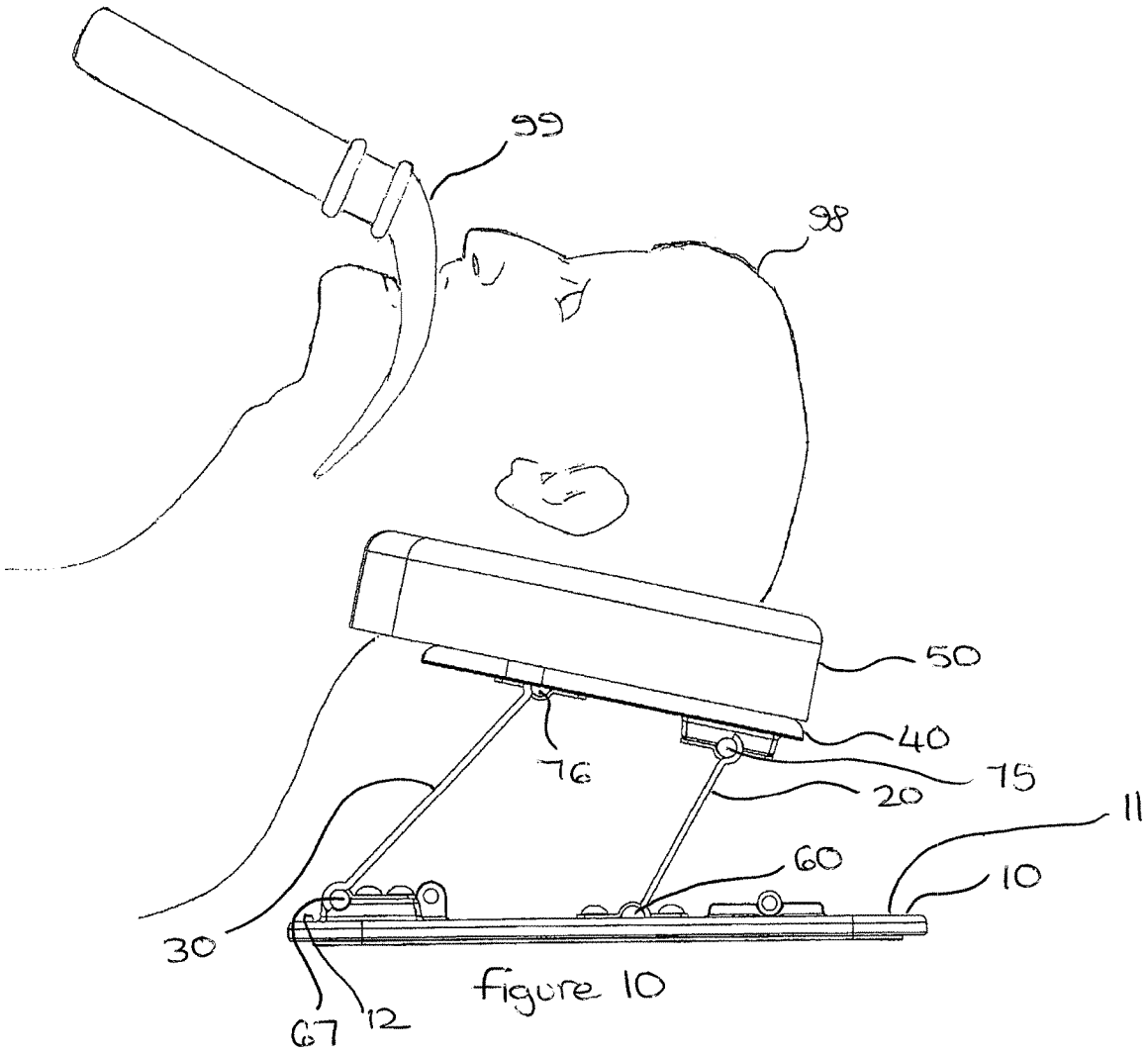
FIG. 10 is a schematic side view of the head positioning device in an elevated position and showing insertion of a laryngeal blade.

FIG. 10 shows the head positioning device 1 with the arms 20, 30 fully extended and the head plate 40 in the elevated position in which it is tilted backward at an angle of 10-12 degrees relative to the base plate 10 and to the horizontal. The proximal end 12 of the head plate 40 is elevated approximately 11 to 12 cm above the base plate 10. In this fully extended position the face of the patient lies in the coronal plane at an elevated height above his/her torso and the anaesthetist can fine tune the elevation of the head plate to achieve the sniffing position. When the anaesthetist sees the patient's glottis coming into view he/she releases the self-locking user operable handle and place the endotracheal tube in the patient's airway. The user operable handle 85 is retracted into its collapsed state so that it is out of the way of the anaesthetist whilst intubation is taking place. The anaesthetist is now free to concentrate on intubating the patient without worrying about the head positioning device 1 moving out of the selected position or the patient moving out of the sniffing position.

In the event that intubation proves to be difficult, the head height of the patient can be adjusted by pressing the user actuatable button 95 to open the bleed valve 94 and lower the head plate 40 and using the handle 85 to adjust (i.e. raise) the height of the head plate 40. Once the patient has been intubated, the bleed valve 94 can be opened to release hydraulic fluid from the drive cylinder 82, lowering the head plate 40 and the proximal arms 30 and distal 20 arms back to the initial base position.

The head positioning device 1 is advantageous in that it is simple and relatively inexpensive to manufacture when compared with the known pneumatic and articulated devices. The simultaneous elevation and tilting of the head plate 40 results in a simple yet effective device that the anaesthetist or other operator can operate easily with one hand leaving the other hand free to insert the laryngeal blade 99 into the patient's airway. The use of the hydraulic actuating mechanism 80 means that the head plate 40 can be raised and lowered safely by the anaesthetist or other operator with one hand leaving the other hand free to perform the laryngoscopy, thus the view into the patient's airway can be easily optimised. Optimisation of the view without needing to lift the laryngeal blade 99 itself reduces the risk of dental injury and patient trauma.

Although the invention has been described with reference to a preferred embodiment, it will be appreciated by those skilled in the art that the invention may be embodied in many other forms.

The invention claimed is:

1. A head positioning device for use in laryngoscopy, the head positioning device comprising:

a base plate having a first proximal end and a first distal end;

a head plate having a second proximal end and a second distal end;

at least one proximal arm pivotally connected between the base plate and at or near the second proximal end of the head plate; and at least one distal arm pivotally connected between the base plate and at or near the second distal end of the head plate, wherein the proximal arm is attached to the base plate at a first location and the distal arm is attached to the base plate at a second location, wherein the second location is spaced apart from the first location, and wherein the second location is closer than the first location to the first distal end of the base plate so that the proximal and distal arms are operable during use to simultaneously elevate the head plate above the base plate and change an angle of tilt of the head plate relative to the base plate such that the second proximal end of the head plate is in a higher elevated position from the base plate than the second distal end.

2. The head positioning device as claimed in claim 1, wherein a distance between the first location and second location is approximately equal to the length of the proximal arm.

3. The head positioning device as claimed in claim 1, wherein a distance between the first location and second location is approximately equal to the length of the distal arm.

4. The head positioning device as claimed in claim 1, wherein the device includes a pair of proximal arms that are laterally spaced from one another over a width of the head plate and a pair of distal arms that are laterally spaced from one another over the width of the head plate.

5. The head positioning device as claimed in claim 1, wherein the distal arms are shorter in length than the proximal arms.

6. The head positioning device as claimed in claim 1, wherein the proximal and distal arms are operable via a hydraulic actuating mechanism.

7. The head positioning device as claimed in claim 6, wherein the hydraulic actuating mechanism includes a user operable handle and a drive rod, the distal arms being fixedly attached to the drive rod for pivotal movement therewith upon user operation of the handle.

8. The head positioning device as claimed in claim 7, wherein the user operable handle is collapsible when the hydraulic actuating mechanism is locked in the second elevated position.

9. The head positioning device as claimed in claim 7, wherein the user operable handle operates a dual action pump that is in fluid communication with a drive rod.

10. The head positioning device as claimed in claim 9, wherein the dual action pump includes a drive cylinder having a piston disposed therein in mechanical communication with the drive rod, and a fluid reservoir, wherein the user operable handle is operable to pump fluid from the fluid reservoir into the drive cylinder to effect movement of the piston and thereby cause pivotal rotation of the drive rod.

11. The head positioning device as claimed in claim 10, wherein the drive cylinder includes a bleed valve for the release of a fluid therein into the fluid reservoir.

12. The head positioning device as claimed in claim 11, wherein the fluid is hydraulic fluid.

13. The head positioning device as claimed in claim 6, wherein the hydraulic actuating mechanism is operable to elevate the head plate from at least a first base position in which it lies substantially adjacent the base plate to a second elevated position in which the head plate is elevated and tilted at the angle such that the proximal end of the head plate is at the higher elevation than the distal end.

14. The head positioning device as claimed in claim 13, wherein the hydraulic actuating mechanism is releasably lockable at the second elevated position.

15. The head positioning device as claimed in claim 14, wherein a locking mechanism of the hydraulic actuating mechanism includes one or more one-way valves for the admission of fluid into the drive cylinder.

16. The head positioning device as claimed in claim 15, wherein the locking mechanism is released by opening the bleed valve(s).

17. The head positioning device as claimed in claim 13, wherein the proximal end of the head plate is elevated to about 11 to 12 cm above the base plate in the second elevated position.

18. The head positioning device as claimed in claim 1, wherein the proximal and distal arms are pivotable via a hydraulic actuating mechanism.

19. The head positioning device as claimed in claim 1, wherein the angle of tilt of the head plate is about 10 to 12 degrees relative to the base plate.

20. The head positioning device as claimed in claim 1, wherein the device includes a head support that is releasably attached to an upper surface of the head plate.

21. The head positioning device as claimed in claim 20, wherein the head support is a generally C-shaped cushion upon which a patient's head is supported.

22. The head positioning device as claimed in claim 20, wherein the head support is made of compliant silicone material.

23. The head positioning device as claimed in claim 20, wherein the head support includes a removable cover.

* * * * *